United States Patent [19]

Panick

[11] Patent Number: 4,530,658

[45] Date of Patent: Jul. 23, 1985

[54] VAPORIZATION BURNER

[75] Inventor: Karl Panick, Planegg, Fed. Rep. of Germany

[73] Assignee: Webasto-Werk W. Baier GmbH & Co., Fed. Rep. of Germany

[21] Appl. No.: 516,381

[22] Filed: Jul. 22, 1983

[30] Foreign Application Priority Data

Sep. 8, 1982 [DE] Fed. Rep. of Germany ..... 3233321

[51] Int. Cl.[3] ..... F23D 13/14

[52] U.S. Cl. ..... 431/329; 126/116 R; 237/12.3 C; 431/328

[58] Field of Search ..... 126/110 B, 110 C, 95, 126/116 R; 431/326-329, 330; 237/12.3 C

[56] References Cited

U.S. PATENT DOCUMENTS 2,879,837 3/1959 Downs ..... 431/328
3,531,229 9/1970 Berglund ..... 431/328 X
3,975,140 8/1976 Placek ..... 431/329

FOREIGN PATENT DOCUMENTS 38477 3/1980 Japan ..... 431/328
578350 6/1946 United Kingdom ..... 431/330

*Primary Examiner*—Larry Jones
*Attorney, Agent, or Firm*—Sixbey, Friedman & Leedom

[57] ABSTRACT

A vaporization burner for a heater operated by means of liquid fuel, especially a motor vehicle heater. The burner is equipped with a combustion chamber and an absorbent body that can be acted upon by fuel via a fuel connection which is disposed on a carrier in the combustion chamber. In order to ensure a fast vaporization of the fuel even in the case of combustion chambers of small dimensions, the carrier is supported in the combustion chamber, so that it is protected against the dissipation of heat from it to surrounding parts.

20 Claims, 2 Drawing Figures

VAPORIZATION BURNER

BACKGROUND AND SUMMARY OF THE INVENTION

This invention relates to a vaporization burner for a heater operated by means of liquid fuel, especially a motor vehicle heater, having a combustion chamber charged with combustion air, wherein an absorbent body, that can be acted upon by fuel via a fuel connection, is disposed on a carrier.

In the known burners of this type (DE-AS 19 48 445 and DE-AS 21 29 663), the carrier for the absorbent body is formed directly by one front wall of the combustion chamber which itself is in connection with the outer housing of the burner conducting heat well. In practice, it is endeavored to minimize the outer dimensions of heaters, especially for motor vehicle heaters. In this case, it becomes more and more difficult to ensure a sufficiently fast vaporization of the fuel despite the small dimensions of the combustion chamber.

This invention is based on the objective of creating a vaporization burner of the initially-mentioned type which, even when the dimensions of the combustion chamber are especially small, ensures a fast change of the supplied liquid fuel, such as gasoline or oil, into the vapor phase.

According to the invention, this objective is achieved by the fact that the carrier for the absorbent body in the combustion chamber is supported so that it is protected against a dissipation of heat therefrom.

Preferably, an air cushion is developed between the carrier and the adjacent wall of the combustion chamber. In this manner, the carrier acts as a heat shield with respect to the surrounding parts of the heater. In order to keep the dissipation of heat from the carrier as low as possible, the mounting of the carrier in the combustion chamber expediently takes place by means of supports having small cross sections and/or being made of a material that does not conduct heat well. In a preferred embodiment of the invention, it has proved to be especially advantageous to support the carrier on the end of the required fuel connection, so that it is suspended in the combustion chamber.

The carrier may simply be developed as an essentially flat carrier disk which is disposed adjacent to and at a distance from a front wall of the combustion chamber. In order to be able to easily exchange the absorbent body, if required, and/or to be able to clean the combustion chamber, a cover, that can be removed from the burner, is advantageously provided as the front wall.

The fuel connection expediently extends through a part of the carrier that is located above the longitudinal axis of the burner. In the case of such a construction, the fuel distribution in the absorbent body is assisted by the force of gravity. As the absorbent body, a heat-resistant layer made of a porous material may simply be provided, such as a fleece or a porous layer of ceramic. In the case of easily vaporizing fuels, such as gasoline, it is preferably provided that the layer covers the carrier in a closed manner so that the vaporization will take place from the side of the layer that faces the combustion chamber. If, however, the burner is operated by means of a fuel that does not vaporize easily, such as oil, the layer is preferably provided with one or more openings which expose parts of the side of the carrier that faces the combustion chamber. In this case, at least part of the fuel is evaporated from the surface of the carrier which heats up especially fast to the temperature required for vaporization. In this case, the vaporization takes place in an especially effective manner if the opening or openings is/are disposed in the central area of the carrier disk, and the cross section of the opening(s) corresponds to not more than 40% of the surface of the side of the carrier facing the combustion chamber. Preferably, no openings are located in the area of the fuel inlet. An ignition device is expediently located in the combustion chamber adjacent to this area.

These and further objects, features and advantages of the present invention will become more obvious from the following description when taken in connection with the accompanying drawings which show, for purposes of illustration only, a single embodiment in accordance with the present invention.

DETAILED DESCRIPTION OF THE PREFERRED EMBODIMENT

Figure 1:
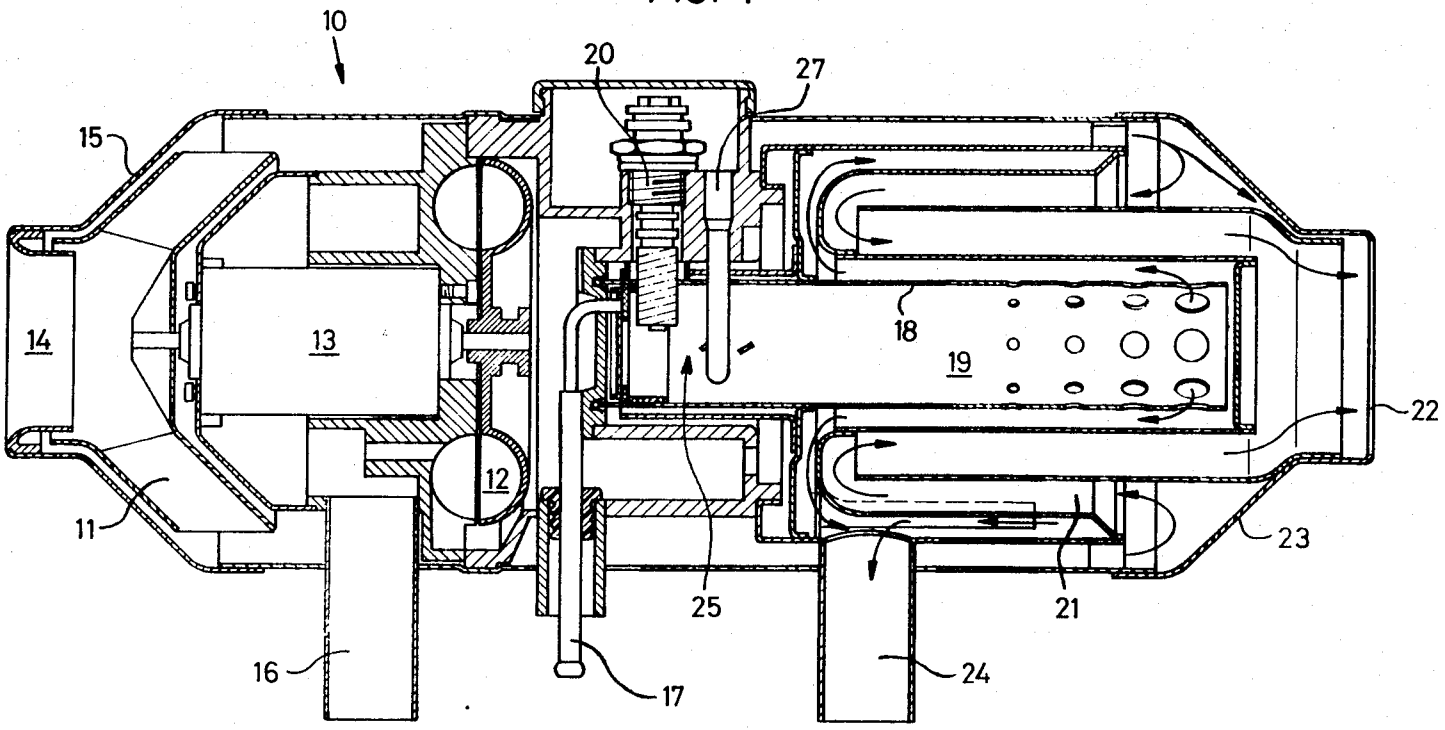
FIG. 1 shows a diagrammatic longitudinal section through a heater having a vaporization burner according to the invention.

In the case of the heater 10 shown in FIG. 1, heating air is drawn in via an inlet opening 14 in a hood 15 by means of a heating-air blower 11. The blower is driven by an electric motor 13, which also serves as the drive of a lateral-channel blower 12. The blower 12 draws in combustion air via an intake connection 16. Fuel is supplied to the heater 10 via a fuel line 17. The fuel is vaporized in a combustion chamber 19, that is defined by a combustion pipe 18, and is mixed with the combustion air supplied by the lateral-channel blower 12. When the heater is turned on, the mixture is ignited by means of an ignition device 20 which may, for example, be a glow plug or a spark plug. From the combustion chamber 19, the hot fuel gases flow over to a heat exchanger 21 where they heat up the heating air supplied by the blower 11. Warm heating air leaves the heater 10 via a discharge opening 22 in a hood 23. The exhaust gases are discharged via an exhaust connection 24. A flame monitor is indicated at 27.

Figure 2:
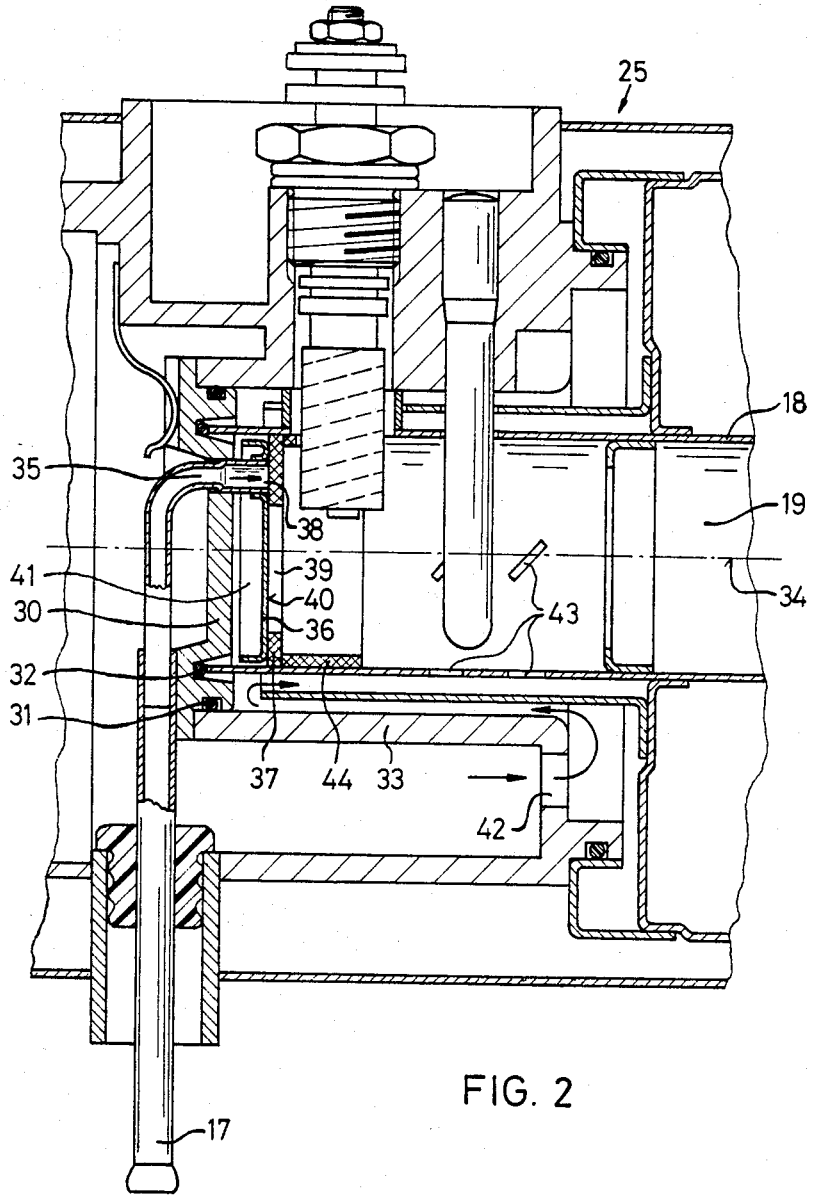
FIG. 2 shows an enlarged view of a section of the heater illustrated in FIG. 1, in the area of the combustion chamber.

As shown in detail in FIG. 2, the vaporization burner, which, as a whole, has the reference number 25, is closed by a removable cover 30. As illustrated, cover 30 is mounted on the front end of the burner, i.e., on the left in FIG. 2, in which case an annular seal 31 is located between the cover 30 and a wall 33 of the burner head, and another annular seal is positioned between the cover 30 and the front end of the combustion pipe 18. The fuel line 17 leads through the cover 30 above the longitudinal axis 34 of the burner. A carrier 36, for a heat-resistant layer 37 made of porous material, is supported on a bent end 35 of the fuel line 17 so that it is suspended in the combustion chamber 19. The layer 37, which, for example, may be formed as a fleece or a porous ceramic body, covers the outlet 38 of the fuel line 17, and is provided with an opening 39 in its central area, with said opening 39 exposing a part 40 of the side of the carrier 36 facing the combustion chamber 19.

Because the carrier 36 is an essentially flat carrier disk, which is disposed adjacent to and at a distance from the cover 30, an air cushion 41 is formed between the cover 30 and the carrier 36. This air cushion 41 acts as a heat shield with respect to surrounding parts of the heater in order to minimize heat dissipation from the carrier 36. This heat dissipation minimizing effect is complemented by the fact that carrier 36 does not contact the wall of the surrounding pipe 18, and by the fact that it is supported only by the relatively small end 35 of fuel line 17.

When the heater 10 is turned on, the lateral-channel blower 12 feeds combustion air into the combustion chamber 19 via a combustion-air inlet 42 of the burner head and twisting slots 43 of the combustion pipe 18. At the same time, a fuel pump (not shown) supplies liquid fuel via the fuel line 17. The fuel reaches a porous layer 37 via the outlet 38. In the layer 37, and in an optional adjacent ring-shaped porous layer 44 on the inside wall of the combustion pipe 18, the fuel is distributed by capillary forces. Because of surface tension and/or the effect of gravity, a thin fuel film is also formed on the exposed part 40 of the surface of the preferably metallic carrier 36. Because the carrier 36, in the illustrated manner, is supported in the combustion chamber 19, so that it is protected against the dissipation of heat, after ignition of the burner by means of the ignition device 20, the carrier 36 and the layer 37 rapidly reach the temperature required for an effective vaporization, which may, for example, be in the range of 400° C.

The layer 37, and the layer 44, which may also be present, act not only as distributors and evaporators, but, at the same time, also have a certain storage function. This makes it possible that, even in the case of an impulse-type supply of the fuel, continuous combustion can be ensured and an essentially continuously burning flame can be generated.

The illustrated embodiment having the opening 39 in the layer 37 is especially well suited for the use of oil or similar fuels. In the case of the use of more volatile fuels, such as gasoline, the exposed parts 40 of the carrier surface may become too hot. Therefore, it is recommended that a closed layer 37, without openings, be used for such fuels. In addition, instead of a single, relatively large opening 39, a plurality of smaller openings may be provided. It is also understood that the present vaporization burner is not limited to the use in air heaters, but may advantageously also be used in water heaters.

While I have shown and described a single embodiment in accordance with the present invention, it is understood that the same is not limited thereto, but is susceptible of numerous changes and modifications as known to those skilled in the art, and I, therefore, do not wish to be limited to the details shown and described herein, but intend to cover all such changes and modifications as are encompassed by the scope of the appended claims.

I claim:

1. A vaporization burner for a heater operated by means of liquid fuel, especially a motor vehicle heater, comprising a combustion chamber, an absorbent body situated for receiving fuel via a fuel connection and disposed on a carrier mounted in said combustion chamber, and air chamber means, disposed between the carrier and an end wall of the combustion chamber, for acting as a heat shield relative to surrounding parts that protects against the dissipation of heat from said carrier.

2. A vaporization burner according to claim 1, wherein said means for protecting comprises the carrier being supported on an end of the fuel connection in a manner such that it is suspended in the combustion chamber.

3. A vaporization burner according to claim 2, wherein the carrier is an essentially flat carrier disk which is disposed adjacent to and at a distance from said end wall of the combustion chamber.

4. A vaporization burner according to claim 3, wherein said end wall is a removable cover.

5. A vaporization burner according to claim 3, wherein a heat-resistant layer, made of a porous material, is provided as the absorbent body.

6. A vaporization burner according to claim 3, wherein the fuel connection extends through a part of the carrier that is located above a longitudinal center axis of the burner.

7. A vaporization burner according to claim 2, wherein a heat-resistant layer, made of a porous material, is provided as the absorbent body.

8. A vaporization burner according to claim 1, wherein a heat-resistant layer, made of a porous material, is provided as the absorbent body.

9. A vaporization burner according to claim 8, wherein the layer of porous material completely covers the carrier on a side facing into said combustion chamber.

10. A vaporization burner according to claim 1, further comprising combustion air supply means for delivering combustion air to said combustion chamber, said air supply means being constructed and arranged so as not to communicate with said air cushion means and to deliver the combustion air into the combustion chamber downstream of said absorbent body and carrier.

11. A vaporization burner for a heater operated by means of liquid fuel, especially a motor vehicle heater, comprising a combustion chamber, an absorbent body situated for receiving fuel via a fuel connection and disposed on a carrier mounted in said combustion chamber, and means for protecting against the dissipation of heat from said carrier to surrounding parts, wherein a heat-resistant layer, made of porous material, is provided as the absorbent body, and wherein the layer of porous material is provided with at least one opening which exposes an imperforate part of a major surface of the carrier facing the combustion chamber for enabling a thin fuel film to be formed on the exposed part and means for delivering combustion air to said combustion chamber so as not to communicate with the upstream side of the exposed part of the carrier.

12. A vaporization burner according to claim 11, wherein the at least one opening is disposed in a central area of the carrier.

13. A vaporization burner according to claim 12, wherein the total area of the cross section of the at least one opening corresponds to up to 40% of the surface of the area of the side of the carrier facing the combustion chamber.

14. A vaporization burner according to claim 12, wherein said protecting means further comprises an air cushion formed between the carrier and an adjacent wall of the combustion chamber.

15. A vaporization burner according to claim 11, wherein the total area of the cross section of the at least one opening corresponds to up to 40% of the surface of the area of the side of the carrier facing the combustion chamber.

16. A vaporization burner according to claim 15, wherein said protecting means further comprises an air cushion formed between the carrier and an adjacent wall of the combustion chamber.

17. A vaporization burner according to claim 11, wherein the layer of porous material is free of openings in the area of a fuel inlet from the fuel connection.

18. A vaporization burner according to claim 17, wherein an ignition device is mounted in the combustion chamber in the area of the fuel inlet.

19. A vaporization burner according to claim 17, wherein said protecting means further comprises an air cushion formed between the carrier and an adjacent wall of the combustion chamber.

20. A vaporization burner according to claim 11, wherein said protecting means further comprises an air cushion formed between the carrier and an adjacent wall of the combustion chamber.

* * * * *